US005573124A

United States Patent [19]

Frost

[11] Patent Number: 5,573,124

[45] Date of Patent: Nov. 12, 1996

[54] HIGH DENSITY SHOWROOM STORAGE AND DISPLAY RACK

[76] Inventor: Michael J. Frost, P.O. Box 307, Cliffside, N.C. 28024

[21] Appl. No.: 337,497

[22] Filed: Nov. 8, 1994

[51] Int. Cl.[6] ..... A47F 5/14

[52] U.S. Cl. ..... 211/181; 211/187; 211/106

[58] Field of Search ..... 211/181, 187, 211/186, 189, 106, 59.1, 57.1

[56] References Cited

U.S. PATENT DOCUMENTS

| | | | |
|---|---|---|---|
| 3,252,434 | 5/1966 | Young, Jr. | 211/181 |
| 3,788,242 | 1/1974 | Hassel et al. | 211/187 |
| 3,977,529 | 8/1976 | Stroh | 211/187 |
| 4,299,327 | 11/1981 | Thauer | 211/181 |
| 4,444,322 | 4/1984 | Lee | 211/187 |
| 4,915,462 | 4/1990 | Le Marchaud et al. | 211/181 |
| 5,253,770 | 10/1993 | Rosenthal | 211/106 |
| 5,299,698 | 4/1994 | Gay | 211/181 |

*Primary Examiner*—Leslie A. Braun
*Assistant Examiner*—Willie W. Berry, Jr.
*Attorney, Agent, or Firm*—Laurence R. Brown

[57] ABSTRACT

The display rack of this invention improves the status of the prior art by incorporating the following functional features, namely: (1) compact profile for high density storage and display of various merchandise configurations, (2) breakdown into easily handled, stored and shipped basic pieces, (3) easily assembled construction of few pieces, and (4) attractive display of a wide variety of stored merchandise. This is achieved by the novel construction afforded by two basic lightweight wire grid framework panels held together in a T-shaped configuration adapted to receive removably mounted shelves in a variety of locations within the confines of a rectangular parallelpiped defined by the framework. The shelves are basket shaped and adapted to mount explicitly for products of various heights on opposite sides of the T leg panel. The entire display rack assembly thus provides a compact cabinet which can be placed in a crowded showroom along an aisle for storing and viewing merchandise removably on the top and three sides. The framework packs stored articles within the entire volume of the cabinet for viewing from a front vertical display rack and two side racks containing vertically disposed removable basket shaped shelves disposed to accommodate merchandise of variable heights and shapes. The front panel constitutes a display rack for hanging merchandise on the outer surface of a lightweight wire rack panel of the T-shaped wire grid framework, which is capped top and bottom by metal end caps having encompassing vertically disposed sidewalls.

7 Claims, 4 Drawing Sheets

HIGH DENSITY SHOWROOM STORAGE AND DISPLAY RACK

TECHNICAL FIELD

This invention relates to display racks, and more particularly it relates to display racks assembled with a framework of easily stored and shipped lightweight wire mesh panel members supporting a set of adjustable wire mesh storage shelves.

BACKGROUND ART

Wire frame and open mesh display racks are known in the art as set forth in the following U.S. patents, for example: 3,252,434, Young, Jr., May 24, 1966; 3,977,529, Stroh, Aug. 31, 1976 and 5,299,698, Gay, April 5, 1994.

However, such prior art racks are of limited capacity, permit very little diversity of products which can be displayed and occupy enough floor space that they are not useful in crowded quarters. Furthermore such racks are constructed so that they do not inherently have the ability to stably carry loads of such heavy objects as gallon cans of paint or boxes containing tire chains, for example. Nor are such racks oriented for use in crowded aisles where items are stored, viewed and removed from three sides of the racks rather than from the front.

It is accordingly an object of this invention to provide improved open wire frame mesh display racks that resolve these prior art deficiencies.

Other objects, features and advantages of the invention will be found throughout the following specification, drawings and claims.

DISCLOSURE OF THE INVENTION

The display rack of this invention has three viewing rack areas, namely the front and two adjacent sides. This is achieved by the rack construction framework with a stably mounted T-shaped frame of two open mesh, lightweight, vertically disposed panels formed of interconnected wire members. The T leg panel forms a frame member for two opposing rows of basket-like shelves accessible from two sides. The T crossbar panel forms a front view rack upon which merchandise may be hung for display. A solid rectangular back panel of pressed wood or the like can back up to a wall or counter with the rack extending into a shopping aisle, so that a customer in the aisle may shop from merchandise displayed on three sides, and even on the top panel if desired.

Generally rectangular top and bottom panel trays with vertical sidewalls encompass the vertically oriented T-connected wire panels and stably hold them to form the most efficient packing density storage forming therewith a generally self supporting vertically disposed rectangular parallelpiped configuration.

There is formed thusly an open mesh lightweight horizontally disposed framework permitting horizontally oriented shelf panels of interconnected wire members to be positioned randomly and removably along the opposite sides of the framework for accommodation of different.sized items of merchandise. The wire mesh members interlock into a load carrying support configuration on both sides of the leg panel for the framework thereby creating a dense storage space with versatile selections of inter-shelf spacings for the display of merchandise of various heights. The framework is strong enough to carry heavy dense merchandise items such as paint, batteries and car chains.

This display rack thus displays merchandise of variable configurations both stored on the accessible side shelves and removably hung upon the crossbar framework panel in high packing density that fits into crowded floor sites. This rack therefore fulfills the foregoing objectives of (1) providing high storage capacity in a limited floor space, (2) permitting a wide diversity of products to be displayed, and (3) stably carrying densely packed merchandise of different configurations, including heavy objects such as gallon cans of paint, etc.

BRIEF DESCRIPTION OF THE DRAWINGS

In the accompanying drawings, wherein like reference characters refer to similar features to facilitate comparison.

THE PREFERRED EMBODIMENT

Figure 1:
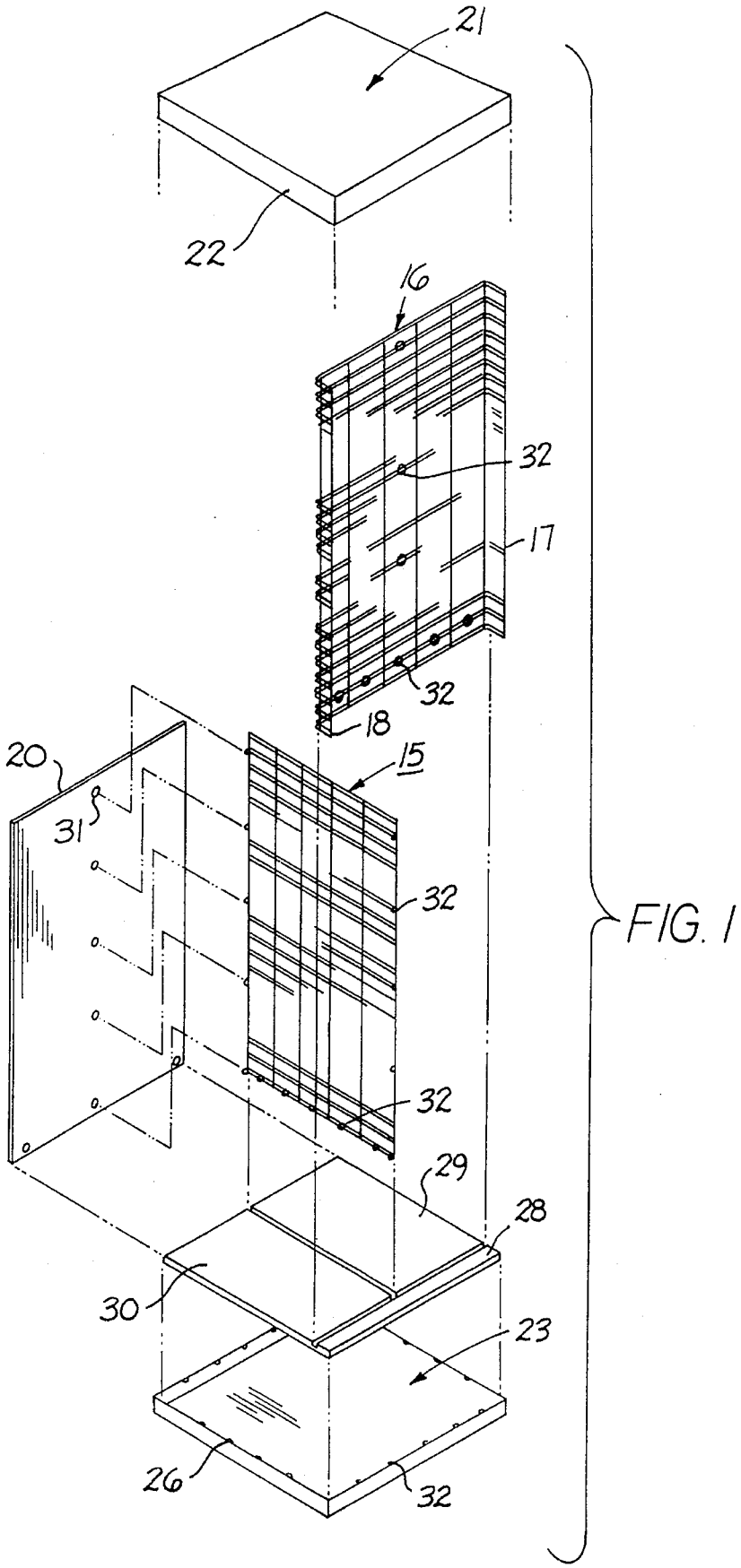
FIG. 1 is an exploded view in perspective of the disassembled display rack framework assembly.
Figure 2:
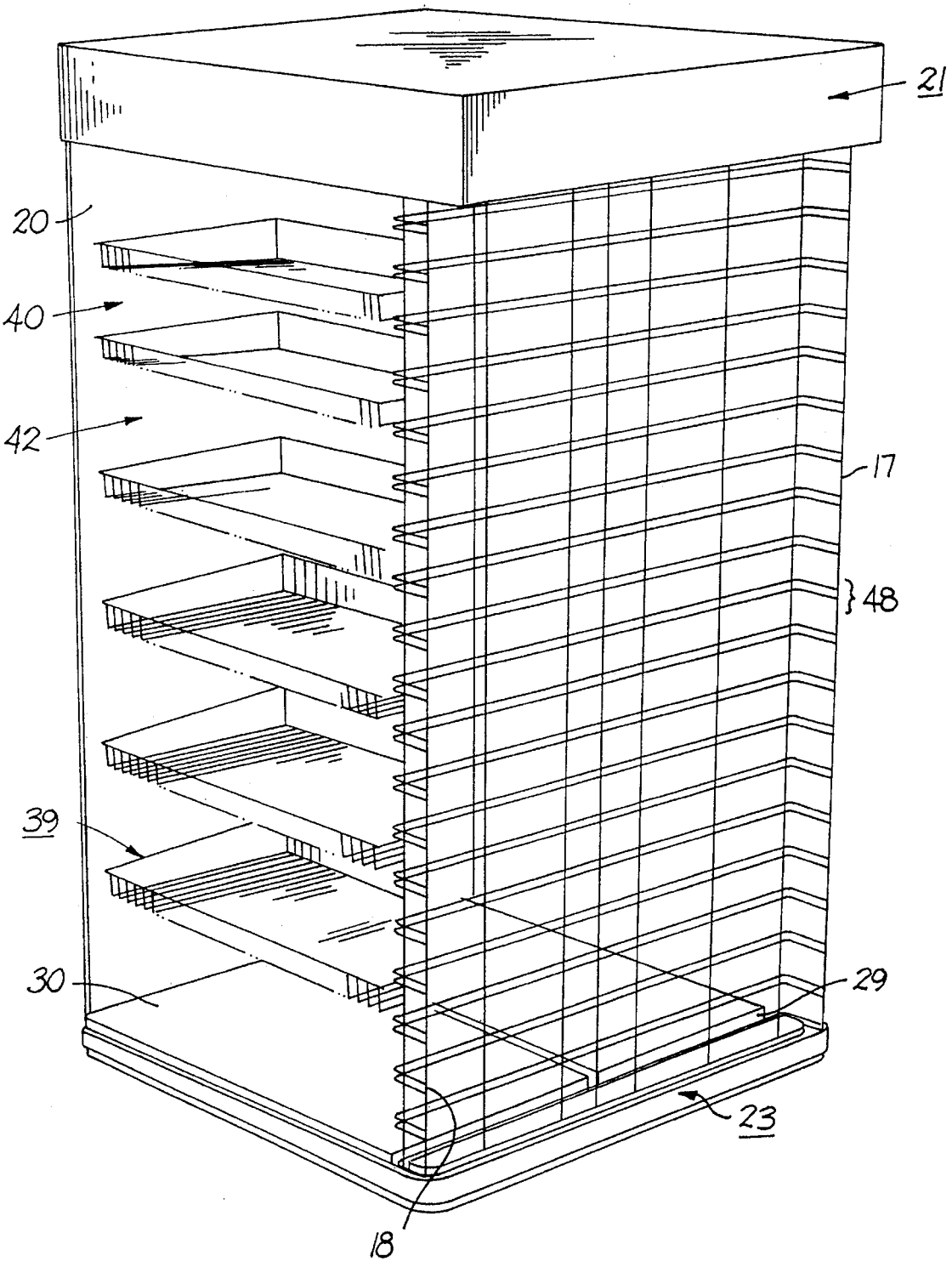
FIG. 2 is a perspective view of an assembled display rack with shelves in place.

The improved display rack of this invention is shown respectively in FIGS. 1 and 2 in pre-assembled form exploded view and in assembled perspective view. Thus, a feature of the rack is that it may be crated in its preassembled state compactly for shipment and storage. The overall framework shape is rectangular parallelpiped. This shape together with other construction features gives ideal packing density for storage of a maximum of merchandise into a small volume. A significantly advantageous feature is that merchandise may be viewed and selected from three sides, so that this rack is ideal in crowded aisles, since it has a small footprint, thus taking up little space yet displaying a large number of items in full view from its three accessible sides and top.

These advantages are obtained from the structural configuration of the framework, best seen in FIG. 1, wherein the two framework vertical panels 15, 16 are arranged respectively as the leg and crossbar of an open mesh T-shaped framework of non-corrodible epoxy coated wire. The crossbar panel member 16 has frontwardly extending flanges 17, 18, which may be used to support rods or hangers for merchandise items and as an outer protective flange so that several items may be stacked on pegs or hangers engaging the wire mesh.

Figure 3:
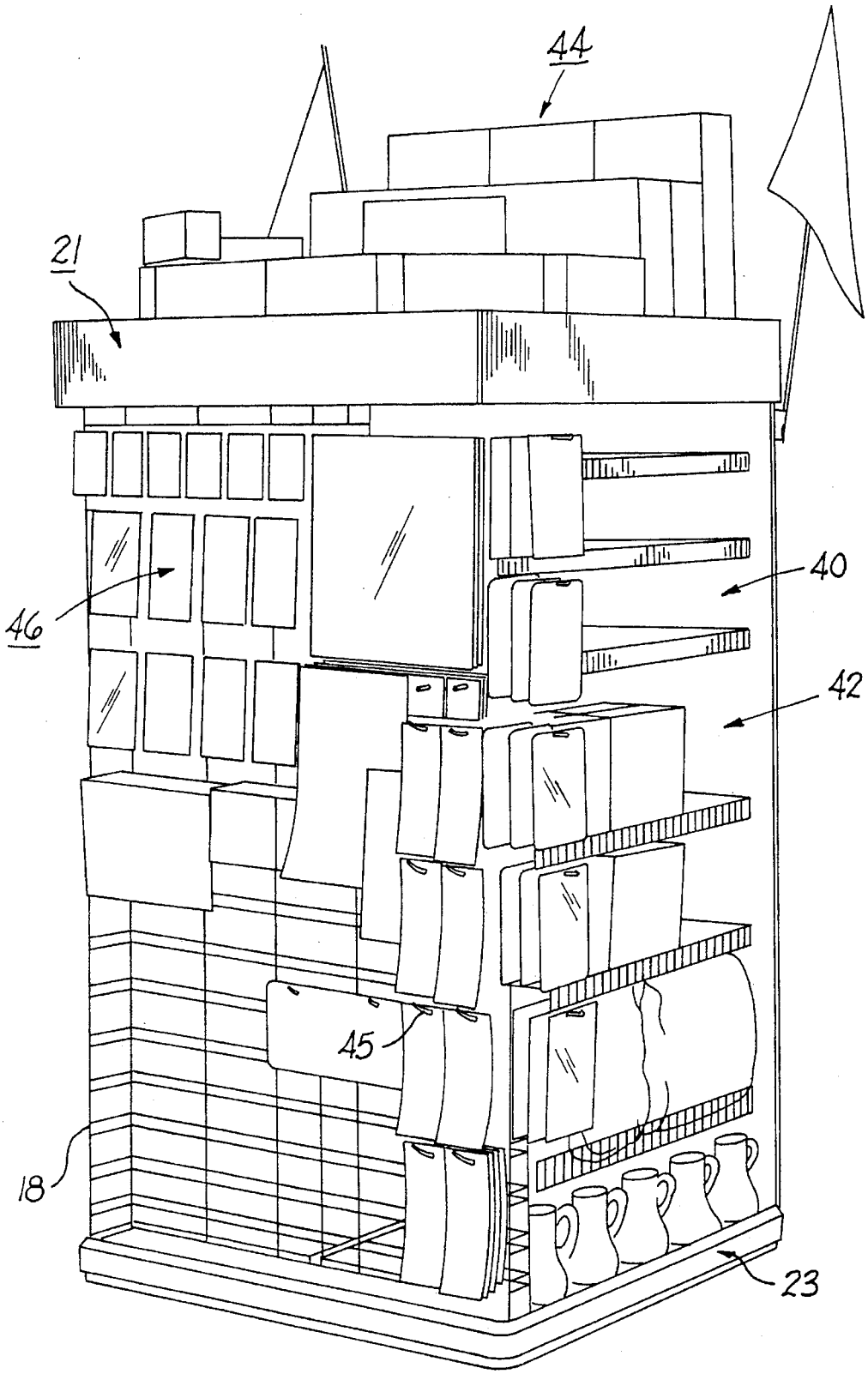
FIG. 3 is a perspective view of the display rack typically loaded with merchandise to display items of various sizes for viewing and selection from the top and three sides, namely two opposite side racks with merchandise arranged on shelves and a front rack with pegs and rods permitting items to be hung in place.

It is significant with the T-Shaped framework wire mesh construction that the center leg panel 15, together with the front mesh panel 18 and the rear flat panel 20 of pressed wood, or the like, supports on opposite sides of the assembled rack a chest-like set of shelves 35 comprising basket like trays arranged at optional spacings to store and display merchandise of variable heights, as seen in FIG. 3 for example. Furthermore the T-shape framework construction feature architecturally provides a more stable rack configuration that can support heavier merchandise such as gallons of paint or boxes of tire chains.

The top cap member 21 is a light metal planar panel with downwardly extending vertical sides 22 help embrace and secure the panel members 15, 16, 20 in a rigid assembly. Similarly the lower foot member 23, with upwardly extending sidewalls, encompasses and secures the panel members 15, 16, 20 and forms a base, namely bottom panel foot member 23, for supporting the rack on a display room floor. The foot member is foreshortened with typical dimensions of 34 ¼ inches by 36 inches and has projection loops 26 for attachment by screws on three sides to the respective panel members 15, 16, and 20. This foot member 23 supports the bottom shelf structure 28 with flat pressed wood panels 29 and 30 that respectively lie on opposite sides of the T-leg panel member 15. Holes 31 in the back panel and loops 32 on the wire mesh members 15, 16 permit fasteners such as bolts to interlock the members 15, 16, 20, 23 stably together in a load supporting rack assembly.

Figure 6A:
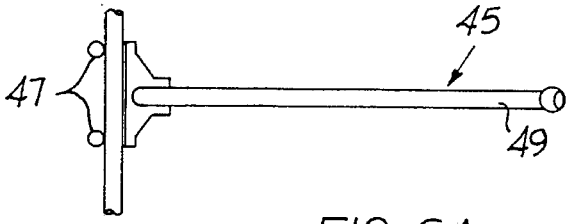
FIG. 6A, 6B and 6C are respectively top, side and front views of hanger pegs for mounting on the front display rack panel.
Figure 6B:
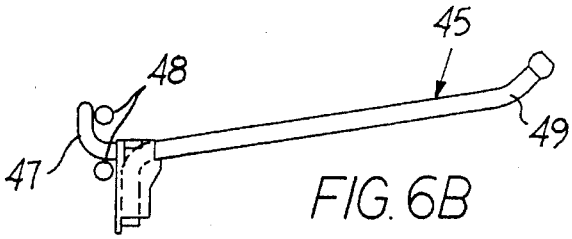
Figure 6C:
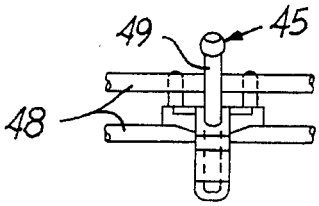

As seen in FIGS. 2 and 3, a set of the basket-like shelves or trays 35 with vertically disposed outer rims that retain items on the shelves within the confines of the rack framework are disposed at will to produce different spacings 40, 42 between the shelves to accommodate merchandise of different heights, depending upon the products to be displayed on the rack. Also items 44 may be displayed on the top member 21. On the front rack, pegs or fittings 45, as shown in FIGS. 6A, 6B, and 6C may be hooked onto the rack for holding and displaying packaged items 46 of various configuration. The dual end hooks 47 thus interengage the pairs of cross brace wires 48 to rest in place by means of the weight of the slightly upwardly pointed pegs 49.

Figure 4:
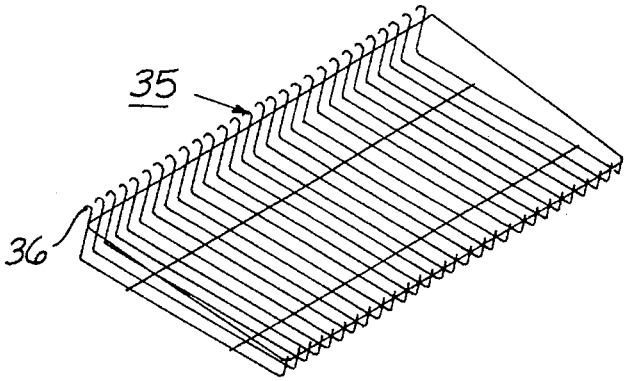
FIG. 4 is a perspective view of the basket-like shelves.
Figure 5:
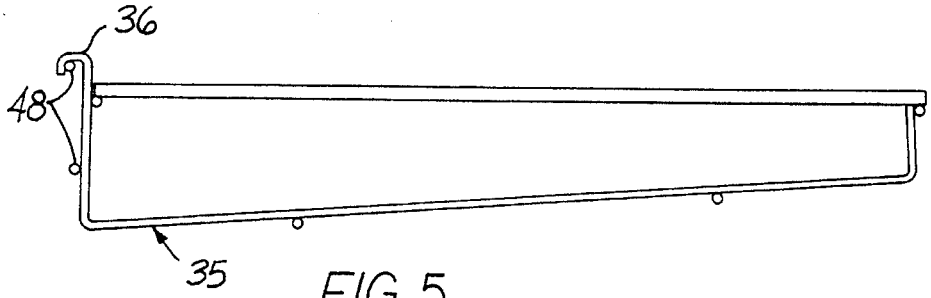
FIG. 5 is a fragmental end view sketch of the interlocking joints between the horizontally arranged shelf trays and the rack framework that permits the shelves to be rearranged into optional positions for carrying merchandize of differing sizes.

The traylike shelves 35, made as the framework panels from welded wires preferably epoxy coated, are shown in FIG. 4. These shelves 35 are supported by hooking the row of hook members 36 onto wire pairs 48 horizontally disposed on the wire (leg) panel 15. Because of the accumulated effect of the rack of hooks 36, the shelves may support items of considerable weight. Heavier items are preferably loaded nearer the bottom of the rack for anchoring ballast and balance.

Having therefore advanced the state of the art with a novel and useful display rack, those features of novelty descriptive of the nature and spirit of the invention are set forth with particularity in the following claims.

I claim:

1. A display rack, comprising in combination:

a stably mounted T-shaped framework of only two open mesh lightweight vertically disposed leg and front crossbar panels formed of interconnected wire members, said panels being firmly connected together to form the framework and comprising spaced horizontal wire members adapted to receive merchandise holding members, generally rectangular back, top and bottom panels by which said framework is stably supported forming therewith a generally self supporting display cabinet configuration, a plurality of horizontally disposed basket-like wire mesh shelves disposed on opposite sides of the leg panel and intermeshed with the leg panel for storing and displaying merchandise, thereby providing a substantially bottom to top merchandise display at two sides, and having merchandise of variable configurations removably hung upon the crossbar framework panel by fittings intermeshing with said horizontal wire members of said front crossbar panel.

2. The rack of claim 1 further comprising horizontally extending vertical wire framework members disposed to extend toward the front of the rack from the crossbar framework panel at the extremities of the T-shaped framework.

3. The rack of claim 1 wherein said top and bottom panel further comprise metallic sheets forming substantially square box-like containers with four vertical sidewalls extending from a flat panel portion to encompass the framework members.

4. The rack of claim 1 wherein said back panel further comprises a solid sheet affixed to the framework leg panel and disposed substantially parallel to the framework crossbar panel.

5. The display rack of claim 1 wherein the leg panel comprises a parallel set of cross brace wires and wherein the shelves are disposed on the wire mesh leg panel by means of wire hooks interengaging pairs of cross brace wires to rest in place by means of weight of the shelves cantilevered from the cross brace wires.

6. A display rack comprising in combination:

two wire mesh panels coupled in a T-shaped array vertically disposed in a display rack with a crossbar panel thereof consisting of only two panels, namely a front display panel and a leg panel thereof normal to the crossbar panel, the leg panel supporting an array of shelves positioned on opposite sides to provide two separate side display compartments, the wire mesh of said front display panel comprising a set of spaced horizontal wire bars, and fixtures intermeshing with the front panel wire mesh with hanging merchandise thereby removably positioned on the front display panel.

7. The display rack of claim 6 wherein the leg panel comprises a parallel set of cross brace wires and the shelves are disposed on the wire mesh leg panel by means of wire hooks interengaging pairs of cross brace wires to rest in place by means of weight of shelves cantilevered from the cross brace wires.

* * * * *